US008261809B2

(12) United States Patent
Shiose et al.

(10) Patent No.: US 8,261,809 B2
(45) Date of Patent: Sep. 11, 2012

(54) METHOD TO MOVE AN UPPER MOLD IN RELATION TO A LOWER MOLD IN A PERMANENT MOLD CASTING MACHINE AND THE PERMANENT MOLD CASTING MACHINE USED FOR THE METHOD

(75) Inventors: Fumikazu Shiose, Toyokawa (JP); Tetsuji Matsui, Toyokawa (JP); Yutaka Murata, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 57 days.

(21) Appl. No.: 12/595,136

(22) PCT Filed: Mar. 28, 2008

(86) PCT No.: PCT/JP2008/056108

§ 371 (c)(1),
(2), (4) Date: Oct. 8, 2009

(87) PCT Pub. No.: WO2008/126704

PCT Pub. Date: Oct. 23, 2008

(65) Prior Publication Data

US 2010/0051224 A1 Mar. 4, 2010

(30) Foreign Application Priority Data

Apr. 9, 2007 (JP) ..... 2007-102025

(51) Int. Cl.
*B22D 18/04* (2006.01)

(52) U.S. Cl. ..... 164/119; 164/306

(58) Field of Classification Search ..... 164/119, 164/306

See application file for complete search history.

(56) References Cited

U.S. PATENT DOCUMENTS 4,304,540 A * 12/1981 Hammon ..... 425/150

FOREIGN PATENT DOCUMENTS

| | | | |
|---|---|---|---|
| JP | 5-49330 | | 6/1993 |
| JP | 2004-90427 | | 3/2004 |
| JP | 2004-255406 | * | 9/2004 |
| JP | 2005-161333 | | 6/2005 |

OTHER PUBLICATIONS

International Search Report from the European Patent Office for International Application No. PCT/JP2008/056108, mailed May 27, 2008.

* cited by examiner

*Primary Examiner* — Kuang Lin

(74) *Attorney, Agent, or Firm* — Finnegan, Henderson, Farabow, Garrett & Dunner, L.L.P.

(57) ABSTRACT

A method for moving an upper mold against a lower mold in a mold casting machine having a mold clamping mechanism attached to a lifting and lowering frame. The mechanism has an upper mold lifting and lowering device that assembles and separates the upper and lower molds by lifting and lowering the upper mold relative to the lower mold and the frame. A space for a setting a core and for taking out products is formed between the upper and lower molds by lifting the device relative to the frame, and by lifting the frame relative to the lower mold. Then the frame is lowered until the upper mold comes close to the lower mold. Thereafter the upper mold is lowered by the device to form an assembled mold, molten metal is introduced into the mold and after the metal has solidified the upper mold is lifted by the device, all while the frame is kept fixed relative to the lower mold.

5 Claims, 15 Drawing Sheets

METHOD TO MOVE AN UPPER MOLD IN RELATION TO A LOWER MOLD IN A PERMANENT MOLD CASTING MACHINE AND THE PERMANENT MOLD CASTING MACHINE USED FOR THE METHOD

FIELD OF THE INVENTION

This invention relates to a method to move an upper mold in relation to lower mold in a permanent mold casting machine and the permanent mold casting machine used for the method.

More particularly, this invention relates to a method to move an upper mold of the permanent mold casting machine wherein the method enables a stable opening of the upper mold of the permanent mold casting machine that manufactures casting products by pouring molten metal via a stoke from a holding furnace into horizontally split molds that consist of the upper and lower molds. The invention also relates to the permanent mold casting machine used for the method.

BACKGROUND OF THE INVENTION

Conventionally there is a permanent mold casting machine that manufactures casting products by pouring the molten metal from a holding furnace via a stoke into a cavity that is formed within the horizontally split molds that consist of the upper and lower molds.

For example, the permanent mold casting machine disclosed in the publication of the Japanese Patent Application, Publication No. S63-273561, belongs to this type of machine. In this permanent mold casting machine, the upper mold is attached to the lower surface of the upper mold base. It is movable up and down and is supported by four supporting frames that are installed around a holding furnace placed on a base table, wherein both (1) contacting the upper mold with the lower mold so as to form a product cavity between the upper mold and the lower mold that is disposed on the lower mold base that is fixed to the supporting frames, and (2) lifting the upper mold so as to form the space for setting of a core and for taking out products between the upper and lower molds, are carried out by the operation of lifting and lowering the upper mold base alone.

The permanent mold casting machine of the conventional structure as described above has a long distance for an upper mold base to travel when it is lifted or lowered. So, the four supporting frames must be very high. Accordingly the supporting frames are apt to bend if they are to support a large weight. Further, when the upper mold and the lower mold are separated, a large load presses the supporting frames. As a result, the supporting frames are apt to bend when the upper mold is opened (mold opening), causing the upper mold to slide in a horizontal direction so that the casting product that is lifted with the upper mold may interfere with the lower mold and be damaged or the washing that is disposed on the lower mold may come off. These problems are particularly conspicuous when the upper and the lower molds have a number of product cavities or complex product cavities. Further, the distance of travel of the upper mold base is long such that the hydraulic cylinder and hydraulic unit that lift and lower the upper mold base should have higher capacities. They become expensive.

In view of these problems, the present invention provides a method to move an upper mold in a permanent mold casting machine and the permanent mold casting machine used for the method, wherein the contact of the upper mold with the lower mold and its separation from the lower mold are carried out by means of a mold clamping mechanism, to which the upper mold is attached, so that the upper mold can carry out the scheduled work even if the distance of travel of the lifting and lowering frame becomes longer, and wherein, further, forming the space for setting of a core and for taking out a product between the upper and lower molds is achieved by the lifting of the mold clamping mechanism, and the upper mold (see the publication of Japanese Patent Application, Publication No. 2004-255406).

However, for the method and the permanent mold casting machine of Publication No. 2004-255406 a hydraulic cylinder and hydraulic unit having higher capacities are not required because of the use of the mold clamping mechanism. But the actuator of the mold clamping mechanism is required to generate a greater power than that required to lift the mold clamping mechanism and the upper mold so that the lifting and lowering frame should not be moved by the force generated at the time of the mold opening. There still remains a problem. Namely, the method and the permanent mold casting machine used for the method must have a very high capacity, especially if the actuator is operated by an electric cylinder, thus making it difficult to increase the speed of the machine.

DISCLOSURE OF THE INVENTION

In view of the above problems, the present invention provides both a method to move an upper mold in a permanent mold casting machine and the permanent mold casting machine used for the method, wherein the permanent mold casting machine enables a stable opening of the upper mold.

A method to move an upper mold of a permanent mold casting machine comprises moving the upper mold in relation to a lower mold whereby molten metal held in a holding furnace is poured via a stoke into a set of molds consisting of the upper and lower molds so as to manufacture a casting product, the permanent mold casting machine comprising a mold clamping mechanism attached to a lifting and lowering frame, wherein the mold clamping mechanism is equipped with an upper mold lifting and lowering means that carries out the assembling and separation of the upper and lower molds by lifting and lowering, relative to the lower mold and the lifting and lowering frame, the upper mold being attached to the lower part of the upper mold lifting and lowering means, wherein the space for setting of a core and for taking out a product is formed between the upper and lower molds by the lifting of the upper mold lifting and lowering means relative to the lifting and lowering frame, and by the lifting of the lifting and lowering frame relative to the lower mold, and wherein the molten metal is poured, while the lifting and lowering frame, to which the mold clamping mechanism having the upper mold is attached, is kept fixed relative to the lower mold, and then the upper mold is separated from the lower mold by the operation of the upper mold lifting and lowering means, while keeping the lifting and lowering frame fixed relative to the lower mold.

Also, the permanent mold casting machine of the present invention pours via the stoke the molten metal held in the holding furnace into a set of molds consisting of the upper and lower molds so as to manufacture a casting product, the permanent mold casting machine comprising a base table; a holding furnace; four supporting frames disposed on the surface of the base table, near their respective four corners; a lower mold base placed across the upper ends of the four supporting frames; a lower mold attached to the lower mold base and placed at the fixed position of the lower mold base; upper mold lifting and lowering cylinders, attached to the two respective supporting frames of the four supporting frames, which two frames are positioned on a diagonal line of the lower mold base; a lifting and lowering frame installed across the upper ends of the rods of the upper mold lifting and lowering cylinders; two guide rods, attached to the two respective supporting frames of the four supporting frames, which two supporting frames are located on the other diagonal line that crosses the above diagonal line, two guide rods movable vertically in sliding movement along the supporting frames and fastened vertically to the lower surface of the lifting and lowering frame and having a fastening portion that fixes the lifting and lowering frame to the predetermined position; a mold clamping mechanism attached to the lifting and lowering frame, the mold clamping mechanism comprising an upper mold lifting and lowering means, to the lower surface of which the upper mold can be attached, and which performs a mold assembling of the upper and lower molds and the separation of the molds by lifting and lowering the upper mold relative to the lifting and lowering frame and to the lower mold that is fixed; and a casting product pushing-out mechanism positioned below the lower part of the lifting and lowering frame, which pushing-out mechanism pushes out and separates from the upper mold, the casting product that adheres to the upper mold when the upper mold and the lower mold are separated after the pouring is completed, wherein the lifting and lowering frame, to which the mold clamping mechanism is attached, can be fastened to the fastening portion of the guide rod.

The permanent mold casting machine of the present invention has the mold clamping mechanism attached to the lifting and lowering frame fixed at the predetermined position by the circular fastening member of the guide rod being engaged by means of a fastening mechanism while the mold clamping mechanism is lowered and kept near the lower mold, where the upper mold is separated from the lower mold. So, the upper mold does not slide much in the horizontal direction from the predetermined position when the upper mold is separated from the lower mold. Thus a stable opening of the upper mold can be achieved.

Also, if the process of lifting and lowering or opening and closing the upper mold is carried out by an electric motor, the opening of the molds, for which great power is required, and the other scheduled work to be carried out by the upper mold, can be carried out without a use of a large servomotor. So, the permanent mold casting machine can be minimized in size and can be operated at a higher speed.

PREFERABLE EMBODIMENT OF THE INVENTION

The operation of the upper mold of the permanent mold casting machine of the present invention and the permanent mold casting machine are explained based on the attached drawings.

Figure 1:
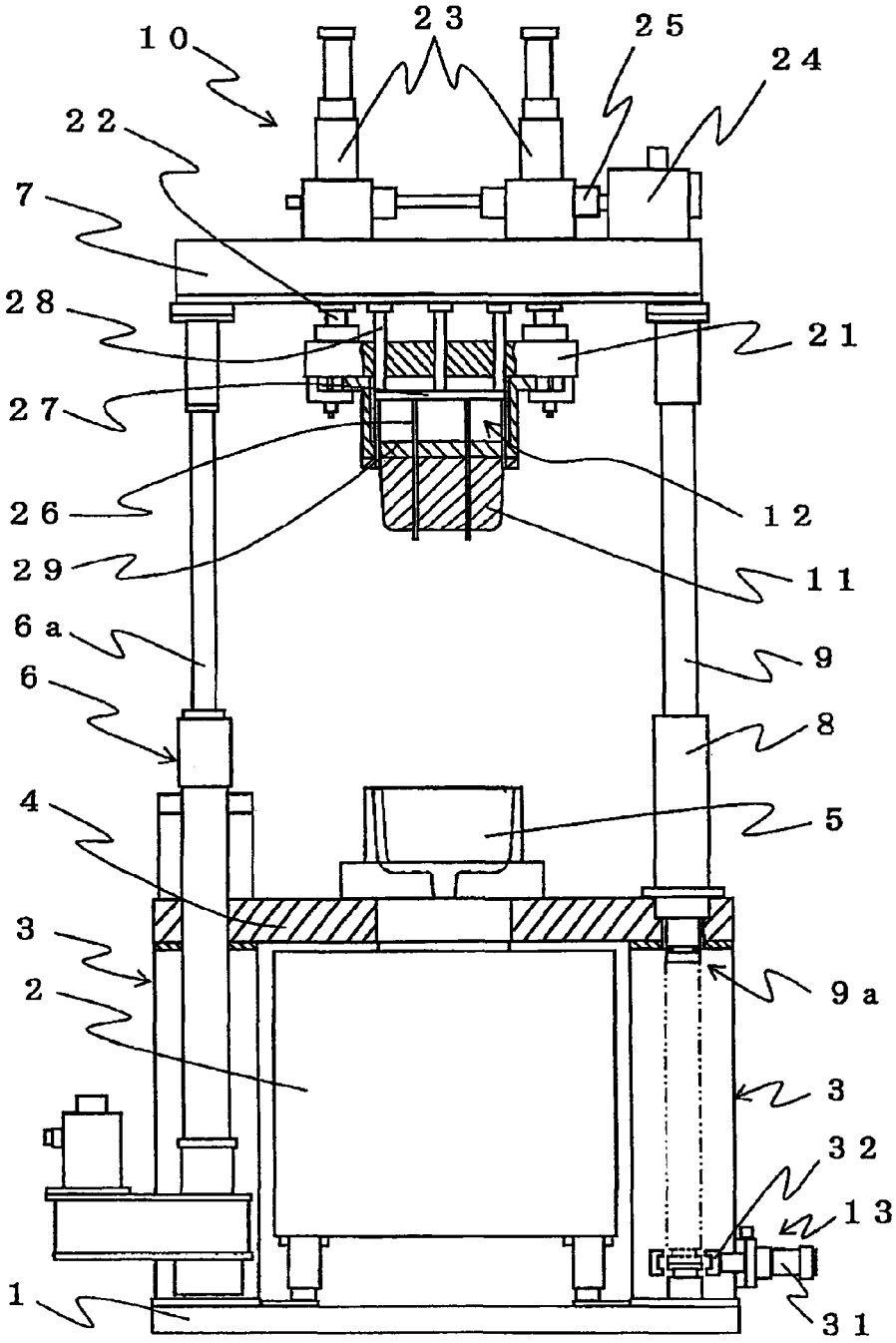
FIG. 1 is a frontal view of the permanent mold casting machine of one embodiment of the present invention, with a part of the view being omitted.
Figure 2:
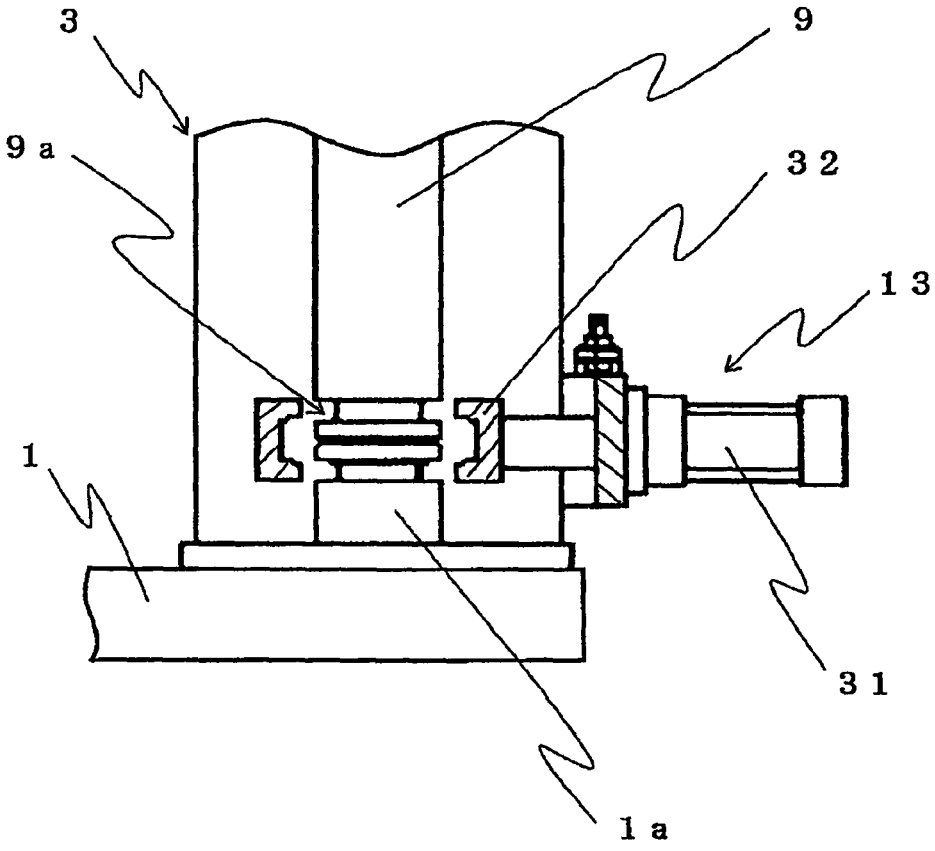
FIG. 2 is an enlarged view of the circular fastening member and the fastening mechanism of FIG. 1.

As shown in FIGS. 1 and 2, the permanent mold casting machine of an embodiment of the present invention comprises a base table 1 of a bottom-plate type;

a holding furnace 2 placed on the base table 1;

four supporting frames 3 disposed on the surface of the base table 1, at the respective four corners;

a lower mold base 4 placed across the upper ends of the four supporting frames 3;

a lower mold 5 attached to the lower mold base 4;

upper mold lifting and lowering cylinders 6, attached to the two respective supporting frames of the four supporting frames 3, which two supporting frames are on a diagonal line of the base table 1;

a lifting and lowering frame 7 placed across the upper ends of the rods 6*a* of the upper mold lifting and lowering cylinders 6;

two guide rods 9, attached to the other two respective supporting frames of the four supporting frames 3 (the two supporting frames 3 that are on the other diagonal line that crosses the above the diagonal line), and movable vertically in a sliding movement along the supporting frames 3, by means of, for example, holders 8, the guide rods being fixed vertically to the lower surface of the lifting and lowering frame 7 and having a circular fastening member 9*a* that has a circular shaped channel and that is used to fasten the lifting and lowering frame 7 to the predetermined position, a mold clamping mechanism 10 disposed on the lifting and lowering frame 7;

an upper mold 11 attached to the lower part of the mold clamping mechanism 10;

a casting product pushing-out mechanism 12 attached to the lower part of the lifting and lowering frame 7, which mechanism 12 pushes out the casting product from the upper mold 11; and a fastening mechanism 13 that engages with a circular fastening member 9*a* of the guide rod 9 and fastens the mold clamping mechanism 10 that is attached to the lifting and lowering frame 7 to the predetermined position.

The lower mold 5 communicates with the holding furnace 2 through a stoke (not shown). An electric cylinder, hydraulic cylinder, or pneumatic cylinder can be used as the upper mold lifting and lowering cylinder 6, depending on the requirements.

The mold clamping mechanism 10, which has a function to have the upper mold 11 contact, and be separated from the lower mold 5, comprises an upper mold base 21 of a rectangular shape having the upper mold 11 attached to it; a pair of connecting rods 22 set upright on the upper surface of the upper mold base, and piercing the lifting and lowering frame 7 in a vertical direction; a pair of an upper mold lifting and lowering means 23 attached to the lifting and lowering frame 7, with the ends of the upper mold lifting and lowering means 23 connected to the connecting rod 22; and an electric motor 24, which is the driving force that drives the upper mold lifting and lowering means 23. The upper mold lifting and lowering means 23 can be, for example, a ball jack that comprises a worm gear and a ball screw. The electric motor 24 can be, for example, a servomotor. In the present embodiment, a pair of the upper mold lifting and lowering means 23 operate in a coordinated movement, and they are connected to the electric motor 24 by a torque coupling 25.

The casting product pushing-out mechanism 12 comprises a plurality of push-out pins 26, that pierce the upper mold 11; a support plate 27 that holds a plurality of push-out pins 26; a plurality (for example, four) of return pins (not shown) that push up the push-out pins 26 and the support plate 27 via the lower mold 5; and a plurality of push-out bars 28 that are disposed on the lower surface of the lifting and lowering frame 7 in the downward direction and that pierce the mold base 21, whereby the plurality of push-out bars 28 relatively push down the support plate 27 when the mold base 21 and the upper mold 11 are lifted by the upper mold lifting and lowering means 23.

The symbol 29 denotes a base to which the upper mold is attached. The base has a shape that secures the space for the upper mold to perform the pushing-out movement.

The fastening mechanism 13 is not limited to any particular type if it has a mechanism wherein the upper mold lifting and lowering means 23 of the mold clamping mechanism 10, which mechanism 10 is attached to the lifting and lowering frame 7, is fastened so that the upper mold lifting and lowering means 23, together with the lifting and lowering frame 7, cannot be moved, whereby the fastening mechanism 13 is engaged with the fastening portion 9*a* of the guide rod 9 at the position where the upper mold 11 is lowered and comes close to the lower mold (the position where the upper mold reaches its lowest point) by having the upper mold lifting and lowering cylinders 6 be contracted. In the present embodiment, as shown in FIG. 2, the circular fastening member 9*a* is disposed at the lower end of the guide rod 9, such that a seat 1*a* having a shape of a circular channel that is symmetrical to the circular fastening member 9*a* is formed on a part of the base table 1, which part faces the lower surface of the guide rod 9. A half nut 32 is used as the fastening mechanism 13, which can be fastened to or unfastened from the circular channel of the circular fastening member 9*a* by the opening and closing movement driven directly, for example, by a hydraulic cylinder 31. Also, the circular fastening member 9*a* is provided at the lower end of the guide rod 9. But it can be provided at locations other than at the lower end of the guide rod 9. Also, the fastening mechanism 13 is disposed at the supporting frame 3, but it can be provided, for example, on the base table 1 or on the floor on which the base table 1 is placed.

Next, the method to move the upper mold of the permanent mold casting machine of the present embodiment is explained. FIG. 1 shows the initial position of the permanent mold casting machine, wherein the upper mold 11, together with the upper mold base 21, is lifted by the upward movement of the upper mold lifting and lowering means 23 of the mold clamping mechanism 10 that is driven by the electric motor 24 and wherein the lifting and lowering frame 7, the mold clamping mechanism 10, and the upper mold 11, are lifted by the movement of the two upper mold lifting and lowering cylinders 6 being extended. When the permanent mold casting machine is at its initial position, namely, the space for setting of a core and for taking out a product is formed between the upper mold 11 and the lower mold 5, the predetermined core (not shown) is placed in the lower mold 5.

Figure 3:
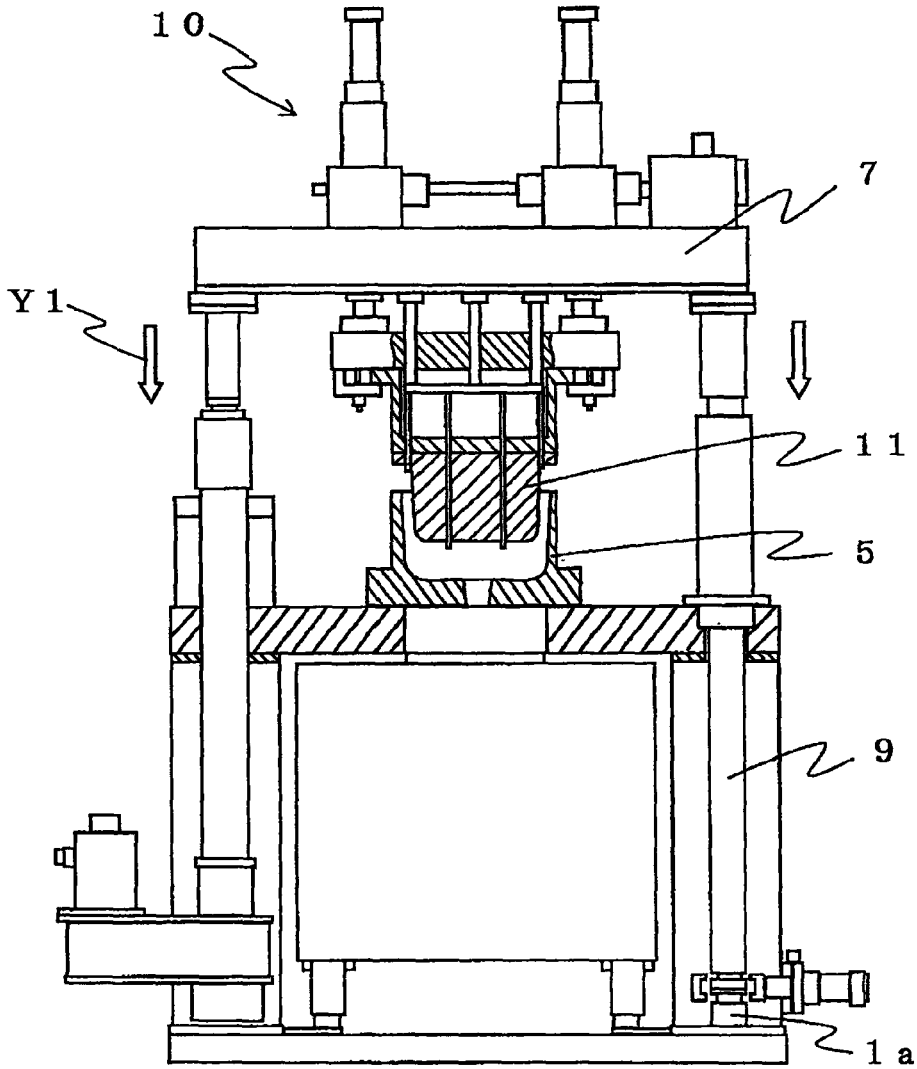
FIG. 3 is a view of the upper mold of FIG. 1 when it is in a lowered position.

Next, as shown in FIG. 3, the upper mold 11 is moved closer to the lower mold 5 by the two upper mold lifting and lowering cylinders 6 being contracted in the Y1 direction and by the lifting and lowering frame 7, the mold clamping mechanism 10 and upper mold 11 being lowered until the lower end of the guide rod 9 comes close to the predetermined position near the seat 1*a*.

Figure 4:
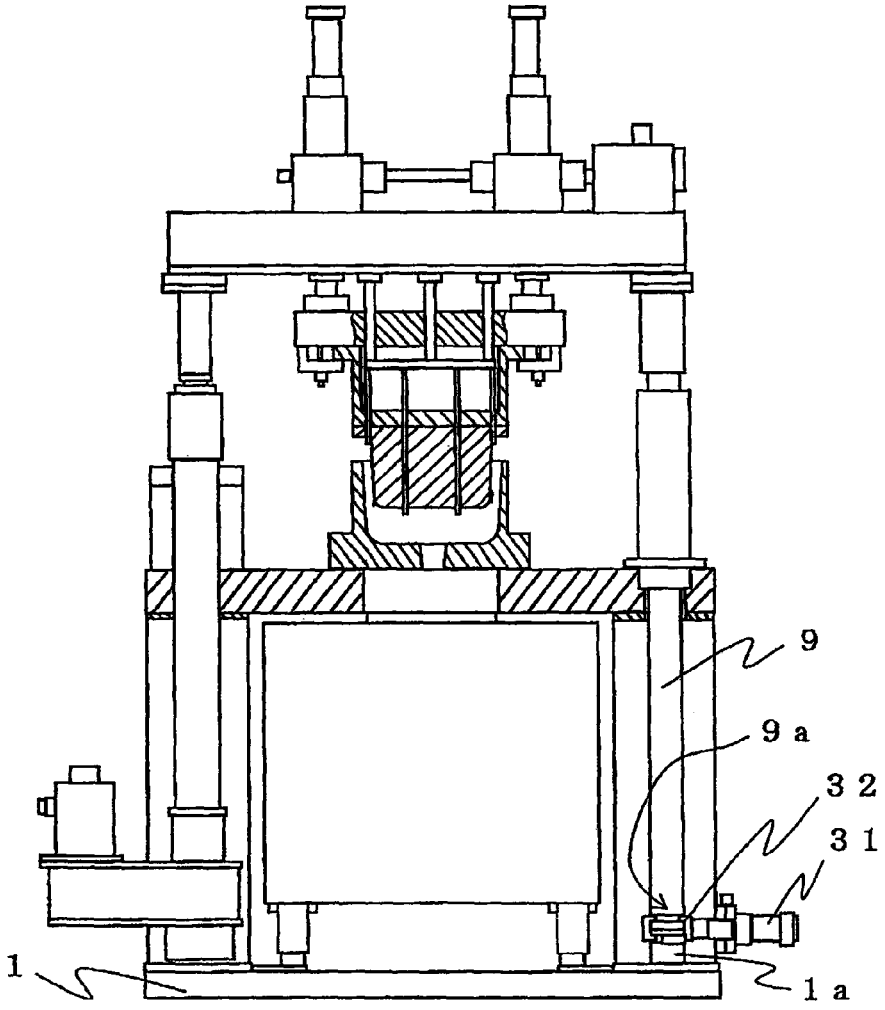
FIG. 4 illustrates how the half nut and the circular fastening member of the guide rod of FIG. 3 are engaged.
Figure 5:
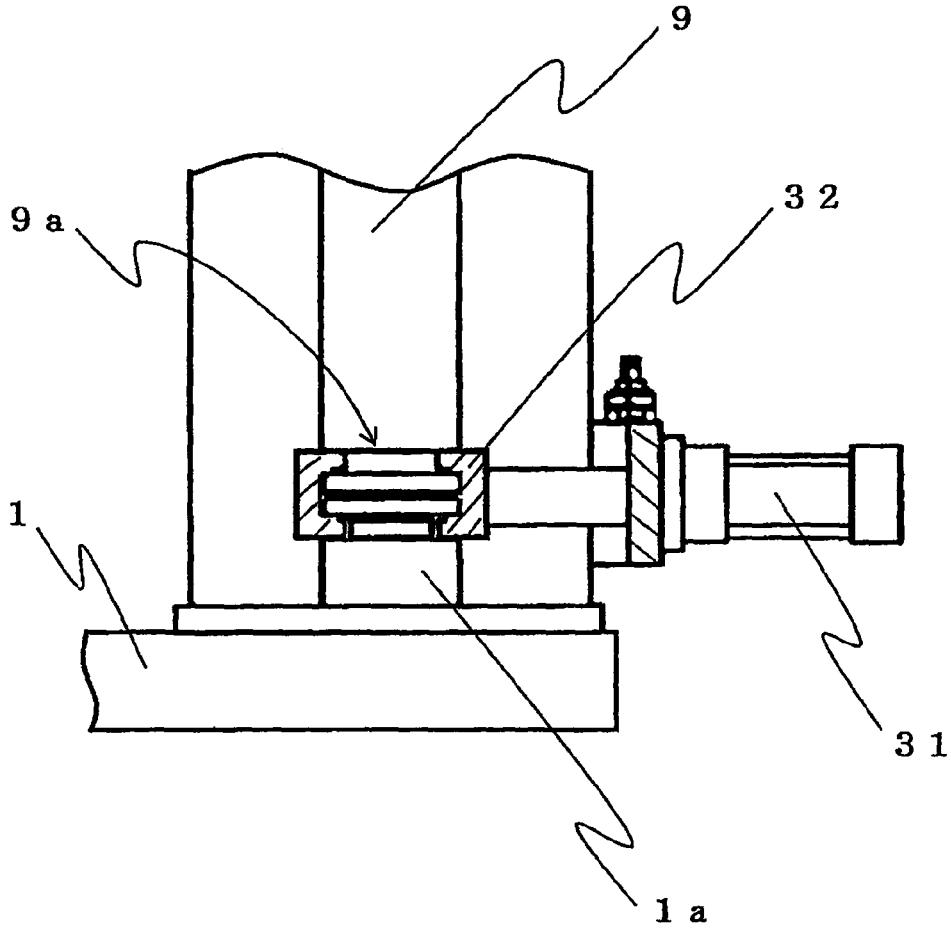
FIG. 5 is an enlarged view of the engaging of FIG. 4

Next, after the guide rod 9 reaches the lowest end, then, as shown in FIGS. 4 and 5, the hydraulic cylinder 31 is driven so as to place the half nut 32 in a position where it is sandwiched between the fastening portion 9*a*, which is at the lower end of the guide rod 9, and the seat 1*a*. Then the half nut 32 is engaged with the fastening portion 9*a* and fixed to the supporting frame 3.

Figure 6:
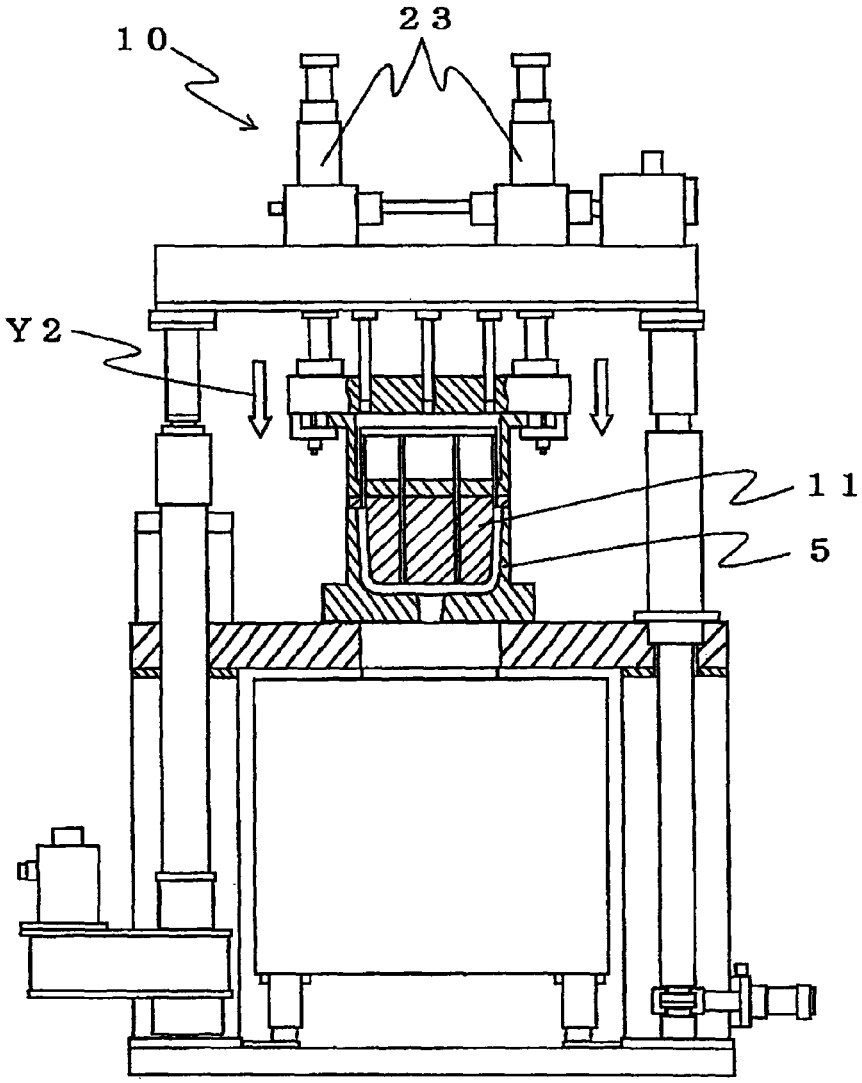
FIG. 6 illustrates how the upper mold of FIG. 4 is located on and fitted to the lower mold.

Next, as shown in FIG. 6, the upper mold 11 is lowered by the downward movement in the Y2 direction of the upper mold lifting and lowering means 23 of the mold clamping mechanism 10. Then the mold assembling is performed by the upper mold 11 being contacted by the lower mold 5.

Figure 7:
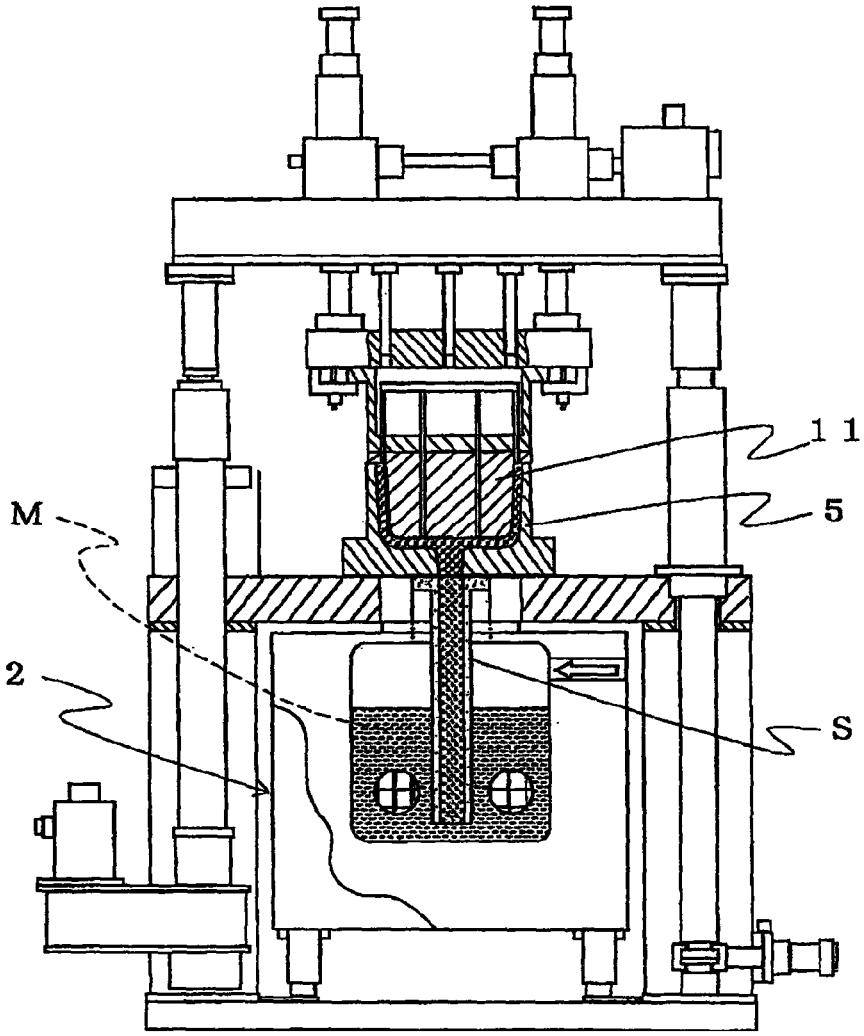
FIG. 7 illustrates the pouring of the molten metal into the product cavity of FIG. 6 formed by the upper mold and the lower mold.
Figure 8:
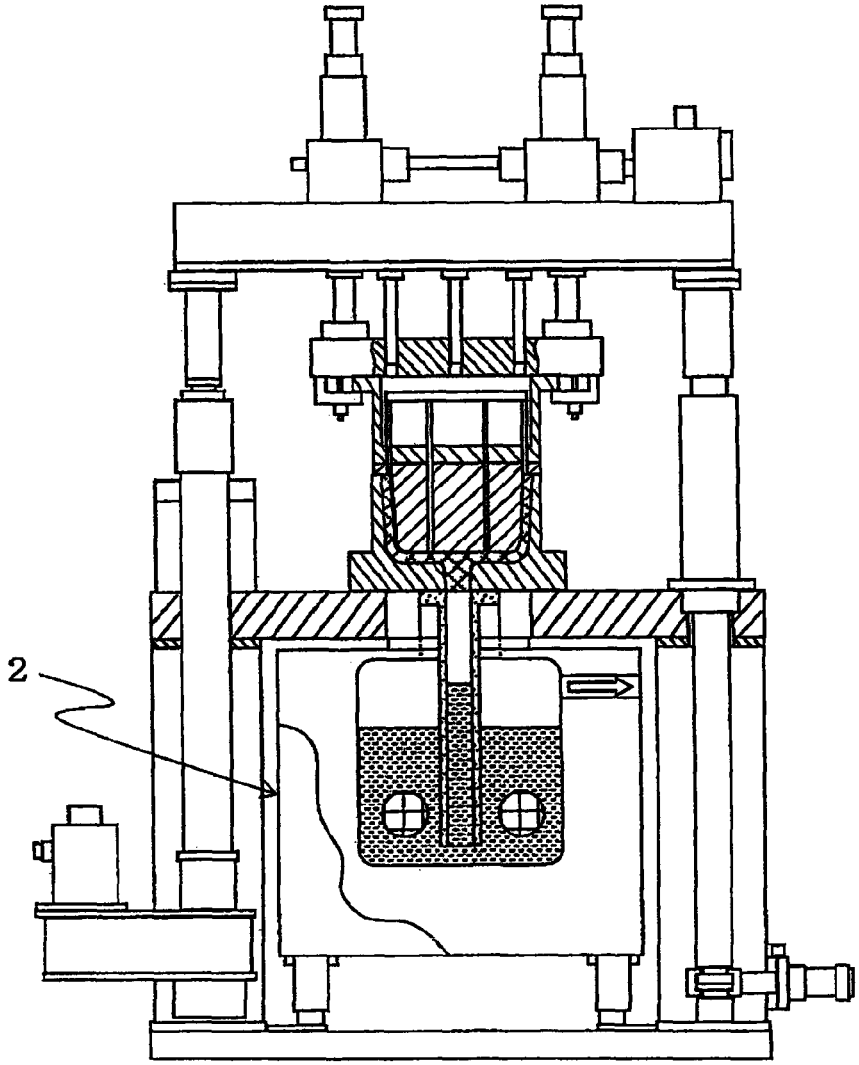
FIG. 8 illustrates the cooling of the casting product of FIG. 7.

Next, as shown in FIG. 7, the molten metal M is poured through the stoke S into the cavity for the product, which cavity is formed by the upper mold 11 and the lower mold 5 by the enclosed holding furnace 2 being pressurized. The pressurizing continues until the molten metal in the cavity becomes solified. After the molten metal becomes solified, then, as shown in FIG. 8, the holding furnace 2 is degassed and the casting product W is cooled.

Figure 9:
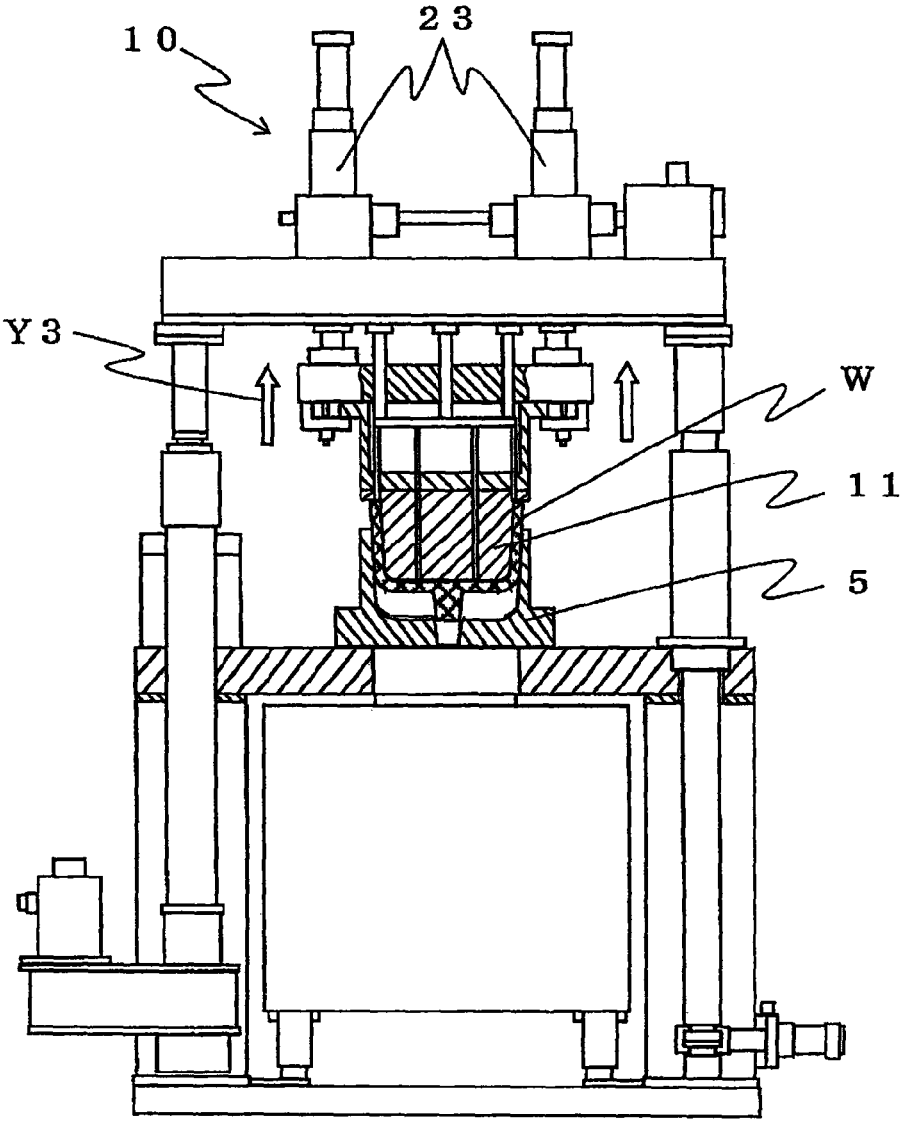
FIG. 9 illustrates the separation of the upper mold from the lower mold of FIG. 8.

After the casting product is cooled to a temperature so that it can be taken out, then, as shown in FIG. 9, the upper mold 11 having the casting product W attached to it is lifted in the Y3 direction a predetermined distance by the upward movement of the upper mold lifting and lowering means 23 of the mold clamping mechanism 10. Then the upper mold 11 is separated from the lower mold 5.

Figure 10:
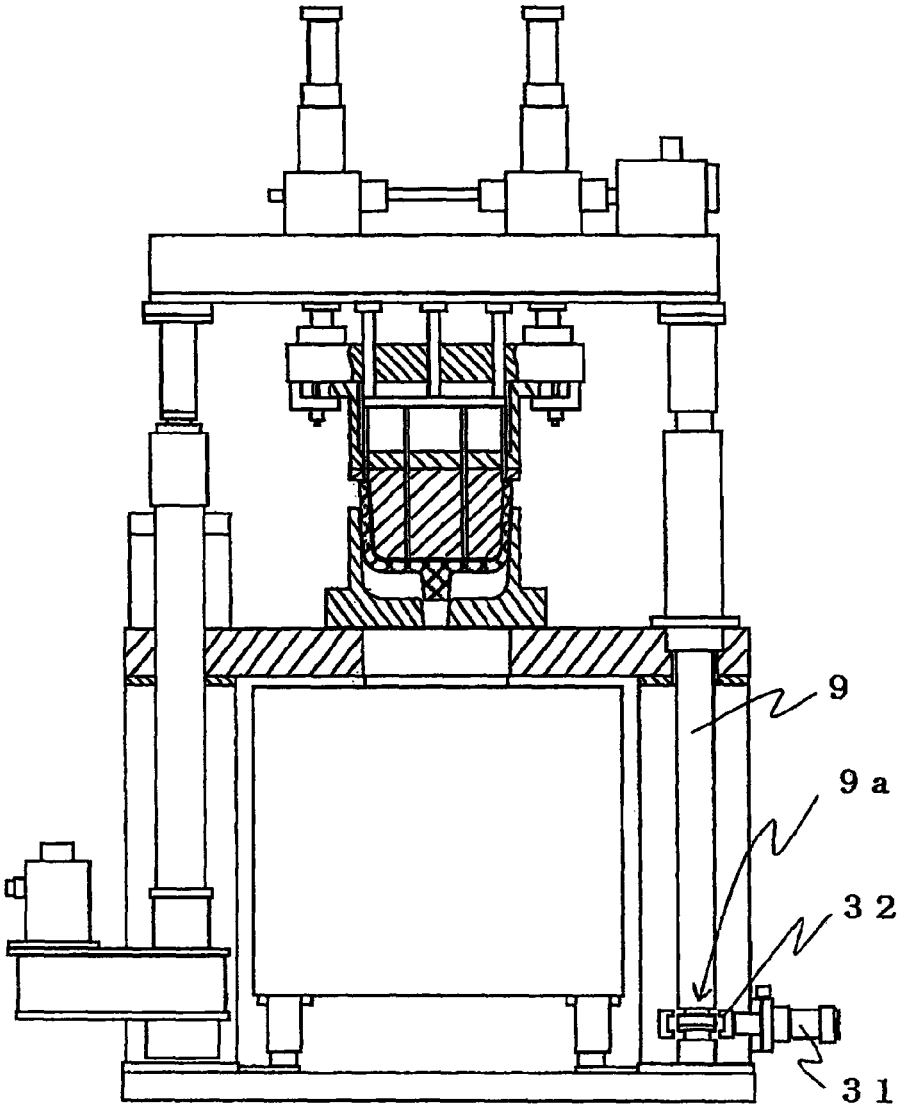
FIG. 10 illustrates how the circular fastening member of the guide rod and the half nut are released from being engaged after the upper mold is separated from the lower mold.

Next, as shown in FIG. 10, after the upper mold 11 is separated from the lower mold 5, the engagement of the half nut 32 and the fastening portion 9*a* is released by the operation of the hydraulic cylinder 31 that is disposed at the lower part of the guide rod 9. Then the fastening of the guide rod 9 is released.

Figure 11:
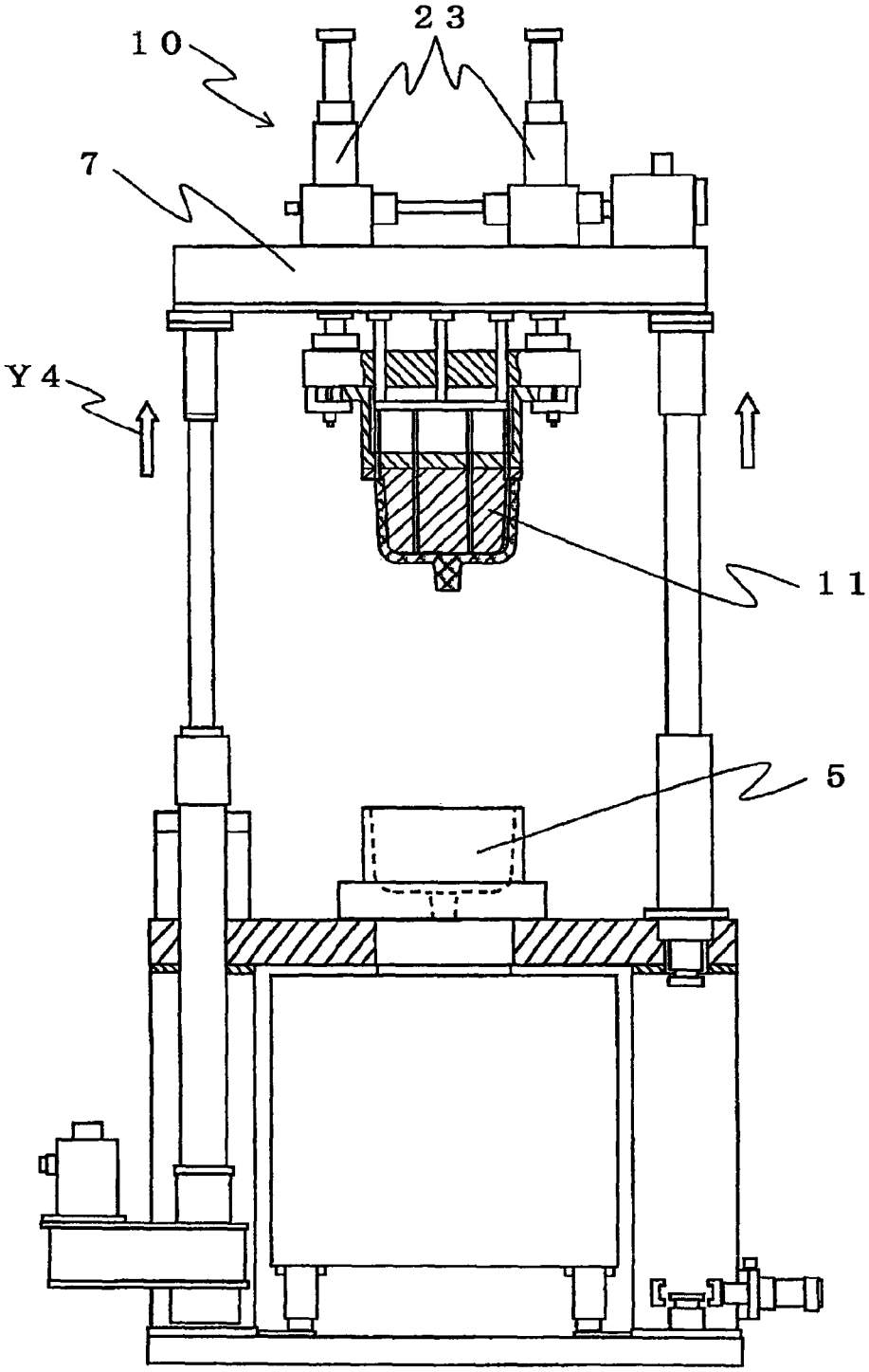
FIG. 11 illustrates how the upper mold of FIG. 10 is lifted.

Next, after the fastening of the guide rod 9 is released, then, as shown in FIG. 11, the lifting and lowering frame 7, the mold clamping mechanism 10 and the upper mold 11, are lifted by the two upper lifting and lowering cylinders 6 being extended in the Y4 direction. Then the space for setting of a core and for taking out a product is formed.

Figure 12:
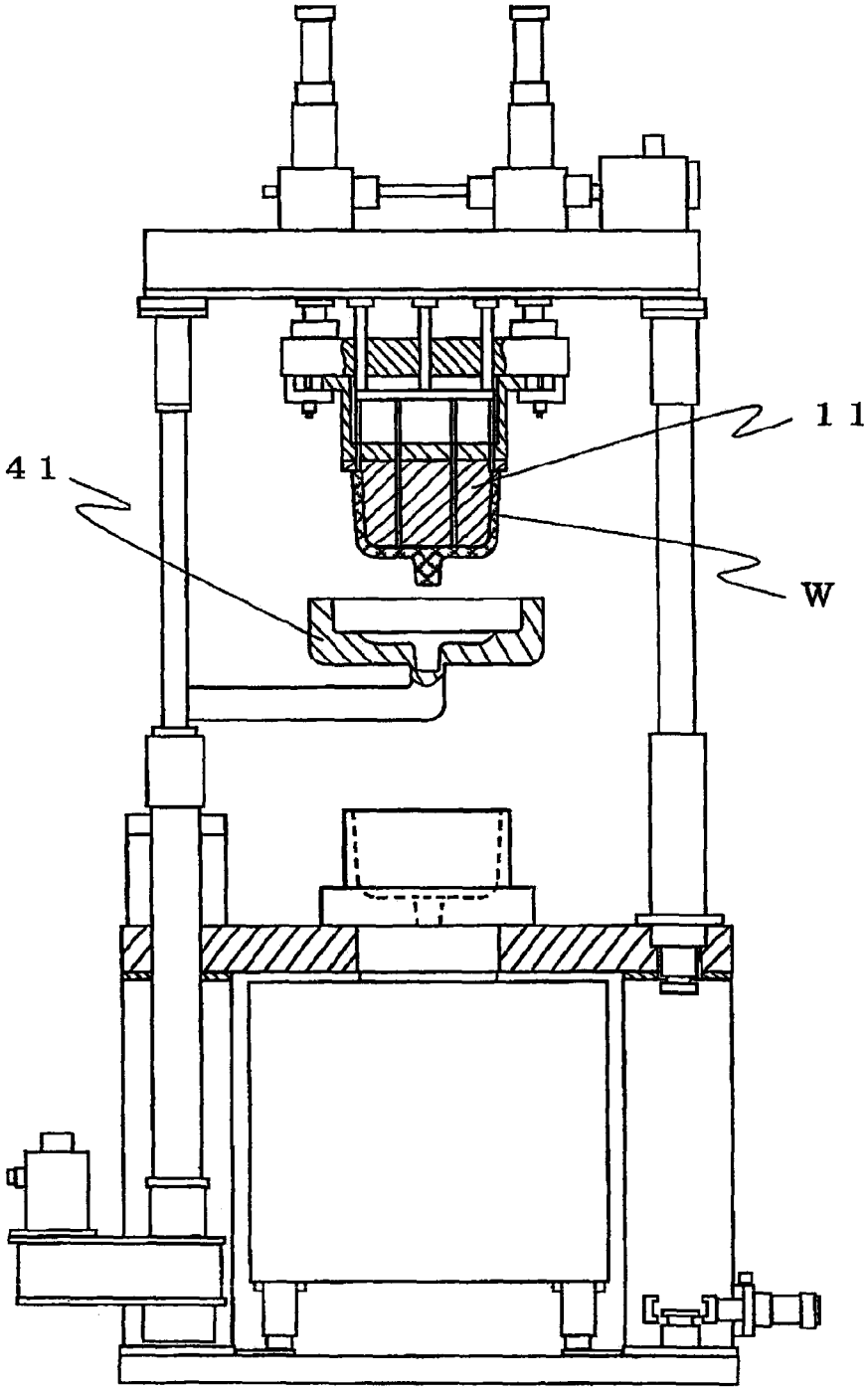
FIG. 12 illustrates how the member for taking out the product is advanced below the upper mold of FIG. 11.
Figure 13:
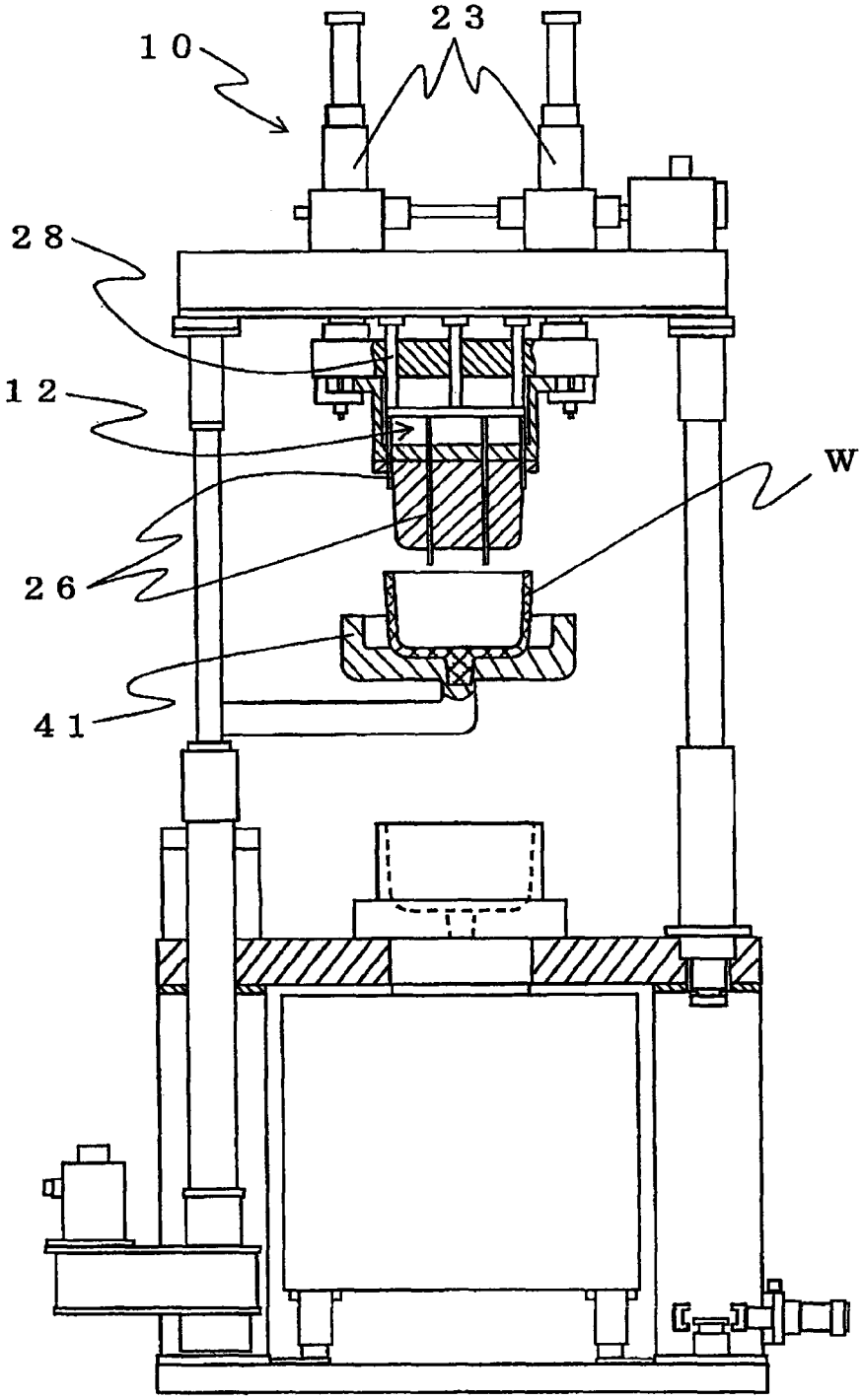
FIG. 13 illustrates how the casting product that is attached to the upper mold of FIG. 12 is pushed out on the member for taking out the product.

Next, as shown in FIGS. 12 and 13, after a member for taking out a product 41 of a taking out device is advanced below the casting product W that is attached to the upper mold 11, the upper mold lifting and lowering means 23 of the mold clamping mechanism 10 is lifted, the push-out pins 26 of the casting product pushing-out mechanism 12 are pushed downward relative to the upper mold 11 by means of push-out bars 28, whereby the casting product W is pushed out from the upper mold 11 on the member for taking out the product 41. This ends one cycle of the operation.

Figure 14:
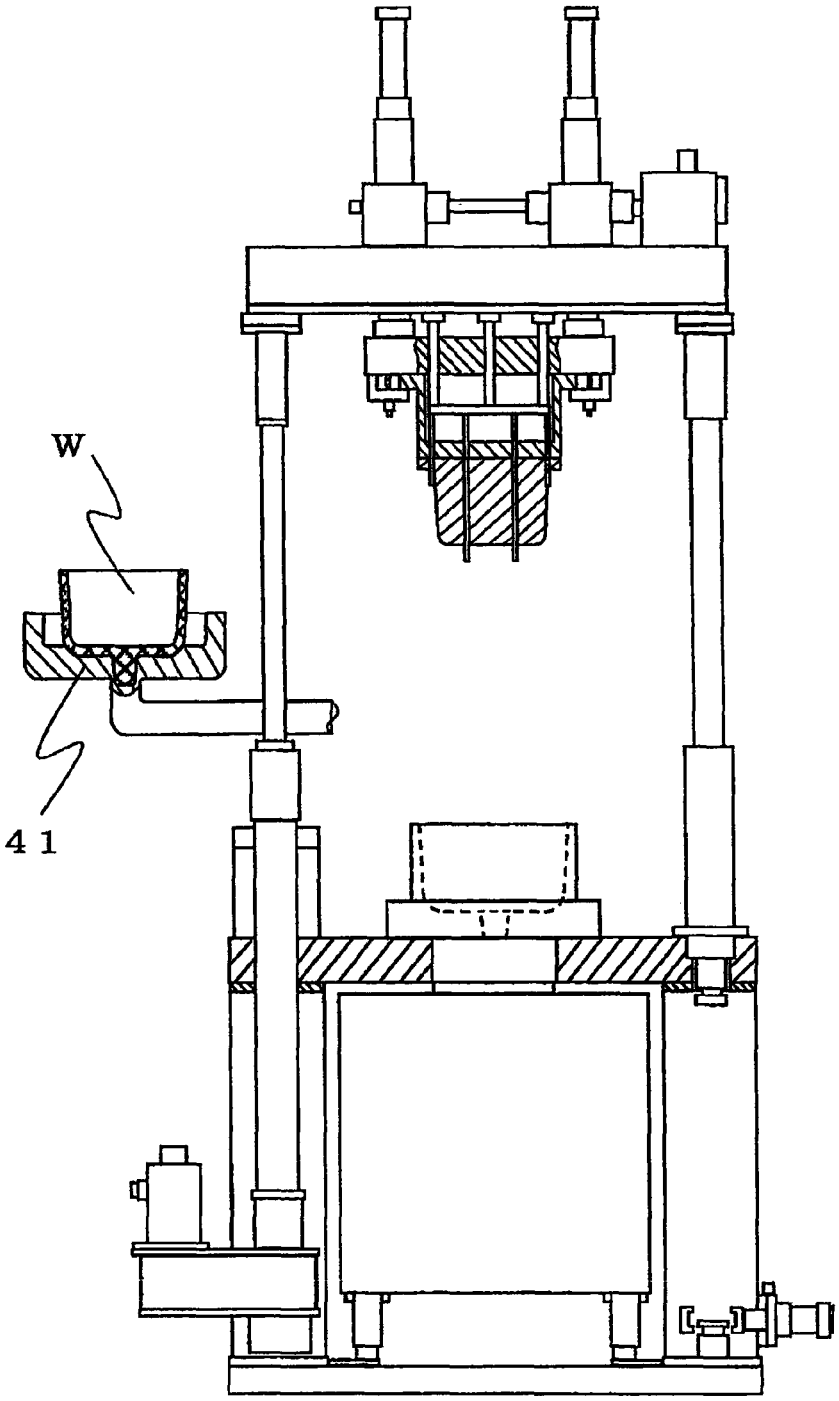
FIG. 14 illustrates how the casting product that is pushed out on the member for taking out the product of FIG. 13 is discharged from the permanent mold casting machine proper.

Next, as shown in FIG. 14, the casting product W that is pushed out on the member for taking out the product 41 is carried out of the casting machine.

In the casting machine of the present embodiment, the upper mold contacts, and is separated from, the lower mold by the mold clamping mechanism to which the upper mold is attached. Further, the space for setting of a core and for taking out a product is formed between the upper mold and the lower mold by the upward movement of the mold clamping mechanism and the upper mold, such that the separation of the upper mold from the lower mold is carried out by the mold clamping mechanism after the mold clamping mechanism moves closer to the lower mold and after the upper mold lifting and lowering means is fastened. So, when the upper mold is separated from the lower mold, the upper mold does not slide much in the horizontal direction from its predetermined position. Thus the stable opening of the upper mold can be achieved.

Also, not only downsizing and the speeding up the operation of the machine, but also lower energy consumption, is advantageously realized, because the upper mold lifting and lowering means, which is not directly affected by the operation of opening and closing the mold, needs only have the power required for lifting and lowering.

The embodiment of the present invention is exemplary, and the present invention is not limited to the examples given in the embodiments. It should be understood that one skilled in the art can make any change or modification to the embodiment of the present invention without changing the scope of the invention. Therefore the scope of the present invention should be interpreted and determined based on the claims.

For example, in the present embodiment, the permanent mold casting machine using a set of the upper and lower molds 5, 11, which molds are to be horizontally split, was explained. But the present invention is not limited to this type of machine. For example, a permanent mold casting machine using vertical split molds consisting of a set of an upper and a lower mold, where the upper mold moves horizontally and is assembled with the lower mold, can be used. Also, in the present embodiment, the holding furnace 2 is placed on the base table 1, but it can also be placed on the floor.

Figure 15:
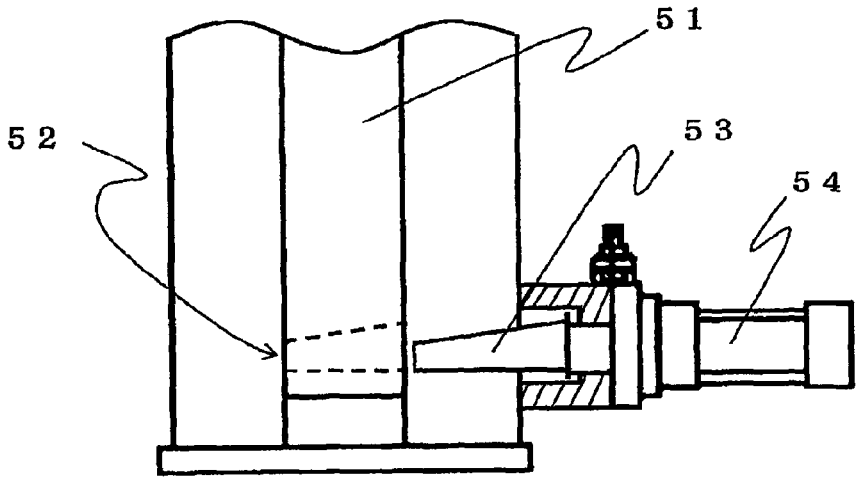
FIG. 15 is an enlarged view of the fastening portion and the fastening mechanism in the other embodiment of the invention.
Figure 16:
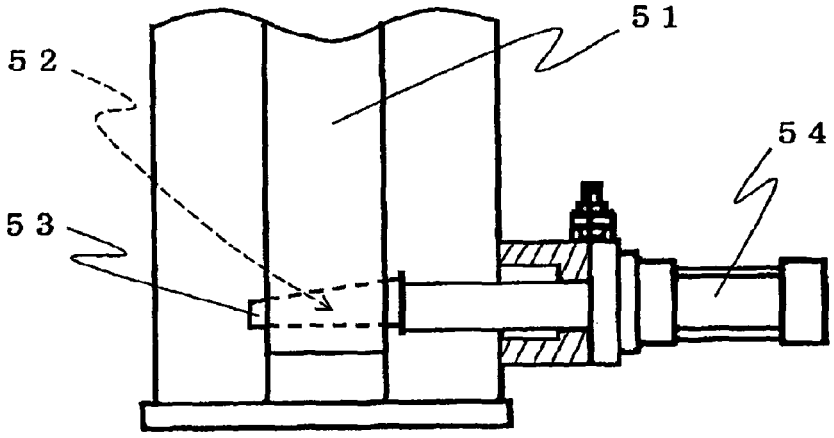
FIG. 16 illustrates the movement of the fastening portion and the fastening mechanism of FIG. 15.

Also, in the permanent mold casting machine of the present embodiments the upper mold lifting and lowering means 23 of the mold clamping mechanism 10 that is attached to the lifting and lowering frame 7 is constructed in a way that it does not move when the upper mold 11 is separated from the lower mold 5, by having the circular fastening member 9*a*, which is disposed at the lower end of the guide rod 9, engaged with the half nut 32 that is used as the fastening mechanism 13. But in the present invention any fastening portion and fastening mechanism can be used if they have the same function as that of this circular fastening member and the half nut 32 that engages with the circular fastening member. For example, as shown in FIGS. 15 and 16, while providing a hole 52 at the lower end of the guide rod 51, an engaging member 53 that has a shape having an inclined angle, such as the angle of a taper key, that can be inserted into and extracted from the hole 52, and that can work as the fastening mechanism, and a direct driving means such as a hydraulic cylinder 54 that drives the engaging member 53, can be used. Also, the position of the hole 52 is not limited to the lower end of the guide rod 51, but it can be placed at positions other than the lower end of the guide rod 51.

In the present embodiment, pouring the molten metal from the holding furnace 2 into the cavity that is formed between the upper and lower molds is carried out by the molten metal, which is being pressurized, that is within the holding furnace 2. But the method of pouring the molten metal into the cavity is not limited to this method. For example, the molten metal can be poured by having the cavity formed between the upper and the lower molds depressurized.

The invention claimed is:

1. A method for moving an upper mold in relation to a lower mold in a permanent mold casting machine that introduces molten metal from a holding furnace into a set of the molds via a stoke, the permanent mold casting machine having a set of upper and lower molds in which molten metal is to be introduced to form a casting product, four supporting frames disposed on a base of the machine near respective four corners of the base, a lower mold base placed across upper ends of the four supporting frames, the lower mold being fixedly attached to the lower mold base, a lifting and lowering frame, two lifting and lowering cylinders for lifting and lowering the lifting and lowering frame attached to two of the supporting frames, two guide rods attached to the other two supporting frames that are vertically slidable in the two other supporting frames and fixed to a lower surface of the lifting and lowering frame and having a fastening portion that fixes the lifting and lowering frame in a fixed position in the machine, a mold clamping mechanism attached to the lifting and lowering frame, the upper mold being attached to a lower part of the mold clamping mechanism and the mold clamping mechanism having upper mold lifting and lowering means that carries out the assembly and separation of the upper and lower molds by lifting and lowering the upper mold, relative to the lower mold and the lifting and lowering frame, and a fastening mechanism that engages with the fastening portions of the two guide rods, the method comprising:

forming a space for setting a core and for taking out a cast product from between the upper and lower molds by lifting the upper mold with the upper mold lifting and lowering means relative to the lifting and lowering frame and by lifting the lifting and lowering frame relative to the lower mold with the two lifting and lowering cylinders;

lowering the lifting and lowering frame and the attached mold clamping mechanism relative to the lower mold with the two lifting and lowering cylinders to lower the upper mold to a position close to the lower mold;

fastening the lifting and lowering frame and the attached mold clamping mechanism in the fixed position in the machine by engaging the fastening mechanism with the fastening portions of the two guide rods so they cannot be moved;

then lowering the upper mold relative to the lower mold with the upper mold lifting and lowering means of the mold clamping mechanism to bring the upper mold into contact with the lower mold and form a mold assembly having a cavity;

introducing molten metal into the cavity of the assembled mold from the holding furnace via the stoke;

lifting the upper mold relative to the lower mold after the molten metal in the mold assembly has solidified a predetermined distance with the upper mold lifting and lower means of the mold clamping mechanism to separate the upper mold from the lower mold, while keeping the fastening mechanism engaged with the fastening portions of the two guide rods and the lifting and lowering frame and the attached mold clamping mechanism in the fixed position;

releasing the fastening mechanism from engagement with the fastening portions of the two guide rods and the lifting and lowering frame and the attached mold clamping mechanism from the fixed position; and lifting the lifting and lowering frame and the attached clamping mechanism relative to the lower mold with the two lifting and lowering cylinders to further lift the upper mold away from the lower mold and form the space for taking out the cast product.

2. A permanent mold casting machine that introduces via a stoke molten metal held in a holding furnace into a set of molds consisting of an upper and a lower mold to manufacture a casting product, the mold casting machine comprising: a base table; a holding furnace; four supporting frames disposed on the surface of the base table near respective four corners of the base table; a lower mold base placed across upper ends of the four supporting frames; a lower mold attached to the lower mold base and placed at a fixed position on the lower mold base; two lifting and lowering cylinders having cylinder rods attached to two of the supporting frames of the four supporting frames, which two supporting frames are located on a first diagonal line of the lower mold base; a lifting and lowering frame installed across the upper ends of the cylinder rods of the two lifting and lowering cylinders; two guide rods attached to the other two supporting frames of the four supporting frames, which two other supporting frames are located on a second diagonal line that crosses the first diagonal line, the two guide rods being movable vertically in sliding movement in the two other supporting frames, and fixed vertically to a lower surface of the lifting and lowering frame and having a fastening portion that fixes the lifting and lowering frame in a predetermined position in the machine; a mold clamping mechanism attached to the lifting and lowering frame, the mold clamping mechanism having upper mold lifting and lowering means, the upper mold being attached to a lower part of the mold clamping mechanism, the upper mold lifting and lowering means carrying out the assembly and separation of the upper and lower molds by lifting and lowering the upper mold relative to the lifting and lowering frame and to the fixed lower mold; a fastening mechanism that engages with the fastening portion of the two guide rods to fix the lifting and lowering frame in the predetermined position in the machine; and a casting product pushing-out mechanism positioned below a lower part of the lifting and lowering frame, which pushing-out mechanism pushes out, and separates from the upper mold, the cast product that adheres to the upper mold when the upper mold and the lower mold are separated after the product has been cast, wherein the upper mold is lowered by lowering the lifting and lowering frame with the lifting and lowering cylinders to bring the upper mold to a position close to the lower mold, the two guide rods are then engaged with the fastening mechanism to fix the lifting and lowering frame in the predetermined position, the upper mold is then lowered into contact with the lower mold to form a mold assembly with the upper mold lifting and lowering means of the mold clamping mechanism, while the lifting and lowering frame remains in the fixed predetermined position, molten metal is introduced into the mold assembly and after the cast product has solidified the upper mold is first separated from the lower mold with the upper mold lifting and lowering means of the mold clamping mechanism, while the lifting and lowering frame remains in the fixed predetermined position and thereafter the upper mold is further lifted by lifting the lifting and lowering frame with the two lifting and lowering cylinders to a position where the casting product can be separated from the upper mold by the pushing-out mechanism.

3. The permanent mold casting machine of claim 2, wherein a driving means that drives the upper mold lifting and lowering means of the mold clamping mechanism is an electric motor.

4. The permanent mold casting machine of claim 2, wherein the fastening portion of the two guide rods is a circular fastening member that has a shape of a circular channel and wherein the fastening mechanism includes a half nut that engages with the circular fastening member.

5. The permanent mold casting machine of claim 2, wherein the fastening portion is a hole or channel and the fastening mechanism includes an engaging member that has a shape having an inclined angle that can engage with the hole or channel.

* * * * *